US005118342A

United States Patent [19]

Kamimura et al.

[11] Patent Number: 5,118,342

[45] Date of Patent: Jun. 2, 1992

[54] PARTIALLY HARDENED SINTERED BODY

[75] Inventors: Tadashi Kamimura, Yokohama; Akira Tsujimura, Chigasaki, both of Japan

[73] Assignee: Isuzu Motors Limited, Tokyo, Japan

[21] Appl. No.: 674,736

[22] Filed: Mar. 26, 1991

[30] Foreign Application Priority Data

Mar. 26, 1990 [JP] Japan ..... 2-76219

[51] Int. Cl.[5] ..... C22C 29/12

[52] U.S. Cl. ..... 75/235; 75/228; 75/230; 419/19; 419/35; 428/552; 428/570

[58] Field of Search ..... 75/228, 230, 235; 419/19, 35; 428/552, 570

[56] References Cited

U.S. PATENT DOCUMENTS 3,650,714 3/1972 Farkas ..... 428/570
4,818,567 4/1989 Kemp et al. ..... 428/570
4,873,148 10/1989 Kemp et al. ..... 428/570

*Primary Examiner*—Stephen J. Lechert, Jr.
*Attorney, Agent, or Firm*—Staas & Halsey

[57] ABSTRACT

A partially hardened sintered body such as a rocker arm comprises powder forming a main body and a capsule-like powder composite disposed adjacent to the powder and composed of core particles made of a material harder than the powder and covering particles covering the core particles and made of the same material as the powder. The powder and the capsule-like powder composite are solidified into the partially hardened sintered body.

4 Claims, 3 Drawing Sheets

PARTIALLY HARDENED SINTERED BODY

BACKGROUND OF THE INVENTION

The present invention relates to a sintered body having a hardened local portion and a method of manufacturing such a partially hardened sintered body.

Products having hardened local portions include rocker arms for moving intake and exhaust valves in internal combustion engines. The rocker arm has a sliding surface held in sliding contact with a cam or a valve, and the sliding surface is required to be resistant to abrasive wear. Rocker arms for internal combustion engines are typically in the form of steel forgings, iron-based sintered bodies, and aluminum die castings.

Steel forged rocker arms are sufficiently strong and rigid. However, a number of machining steps are required to grind the forged rocker arms and an abrasion-resistant member of cemented carbide needs to be brazed or otherwise bonded to the sliding surface to be held in contact with a valve or a cam.

The iron-based sintered rocker arms do not need to be machined to a large extent after the sintering process. However, an abrasion-resistant member of cemented carbide has to be brazed, in an inert atmosphere, to the sliding surface to be held in contact with a valve or a cam.

The aluminum die-case rocker arms have an abrasion-resistant member of cemented carbide or ceramics cast on the sliding surface to be held in contact with a valve or a cam. However, the abrasion-resistant member thus attached to the aluminum die-cast rocker arms is not necessarily satisfactory. Japanese Laid-Open Patent Publication No. 62(1987)-38810 discloses a rocker arm of aluminum alloy which has a sliding surface for contact with a cam, the sliding surface being in the form of a composite layer which comprises fine powder of an intermetallic compound or ceramic material dispersed in an aluminum alloy matrix. The sliding surface of the disclosed rocker arm, however, does not have a satisfactory level of abrasion resistance because it is difficult to produce a composite structure of the intermetallic compound or ceramic material in the aluminum alloy matrix. In addition, a high-density energy source such as a laser gun should be employed to construct the composite layer.

SUMMARY OF THE INVENTION

It is an object of the present invention to provide a partially hardened sintered body which can easily be formed and requires a relatively small amount of machining after it is formed, and which has a hardened portion that is reliably provided, and a method of manufacturing such a partially hardened sintered body.

Another object of the present invention is to provide a partially hardened sintered body which has a hardened portion whose property can be selected depending on the required function thereof irrespective of the material of the sintered body, and a method of manufacturing such a partially hardened sintered body.

According to the present invention, there is provided a method of manufacturing a partially hardened sintered body having a main portion and a hardened portion, comprising the steps of filling a sintering mold with powder for forming the main body, filling a portion of the sintering mold with a capsule-like powder composite which is composed of core particles of a material harder than the powder for forming the main body and covering particles covering the core particles and made of the same material as the powder for forming the main body, and sintering the powder and the capsule-like powder composite which are filled in the sintering mold.

According to the present invention, there is also provided a method of manufacturing a partially hardened sintered body having a main portion and a hardened portion, comprising the steps of sintering the main portion of powder for forming the main body, setting the main portion in a sintering mold, placing, at a location on the main portion set in the sintering mold, a capsule-like powder composite which is composed of core particles of a material harder than the powder for forming the main body and covering particles covering the core particles and made of the same material as the powder for forming the main body, and sintering the capsule-like powder composite which is placed at the location on the main portion.

According to the present invention, there is further provided a partially hardened sintered body comprising powder forming a main body and a capsule-like powder composite disposed adjacent to the powder and composed of core particles made of a material harder than the powder and covering particles covering the core particles and made of the same material as the powder, the powder and the capsule-like powder composite being solidified.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
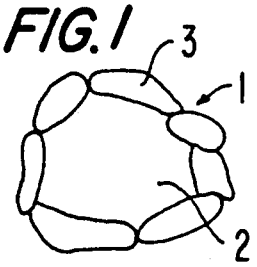
FIG. 1 is a schematic diagram showing a powder composite to be sintered into a partially hardened sintered body according to the present invention.

As shown in FIG. 1, a capsule-like powder composite particle 1 which is to be sintered into a partially hardened sintered body comprises a core particle 2 and a plurality of particles 3 covering the surface of the core particle 2. The core particle 2 may be of a hard material such as alumina ($Al_2O_3$). The powder composite particle 1 may be produced as follows: The covering particles 3 are adhered to the surface of the core particle 3 under electrostatic forces when mixed with the core particle 2. Then, the mixture is placed into a housing having rotary vanes, and rotated under centrifugal forces by the rotary vanes until the covering particles 3 are firmly attached to the surface of the core particle 2 through mechanical bonding. Such a process of producing the powder composite particle 1 is disclosed in Japanese Laid-Open Patent Publication No. 62(1987)-250942, for example.

Figure 2:
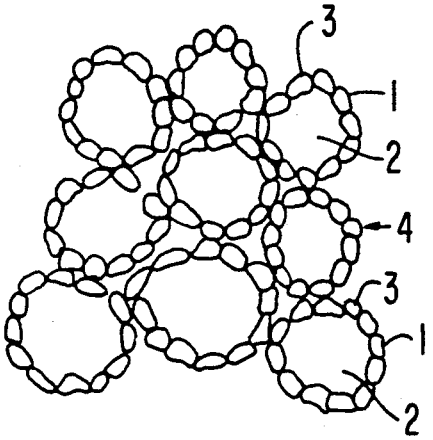
FIG. 2 is a schematic diagram showing a cluster of powder composites.

FIG. 2 shows a solid mass or cluster 4 of capsule-like powder composite particles 1 which are sintered. The core particles 2 each covered with the covering particles 3 are securely coupled together into a unitary structure by the covering particles 3 that are bonded to each other. The cluster 4 thus formed serves as a sintered body according to the present invention.

Figure 3:
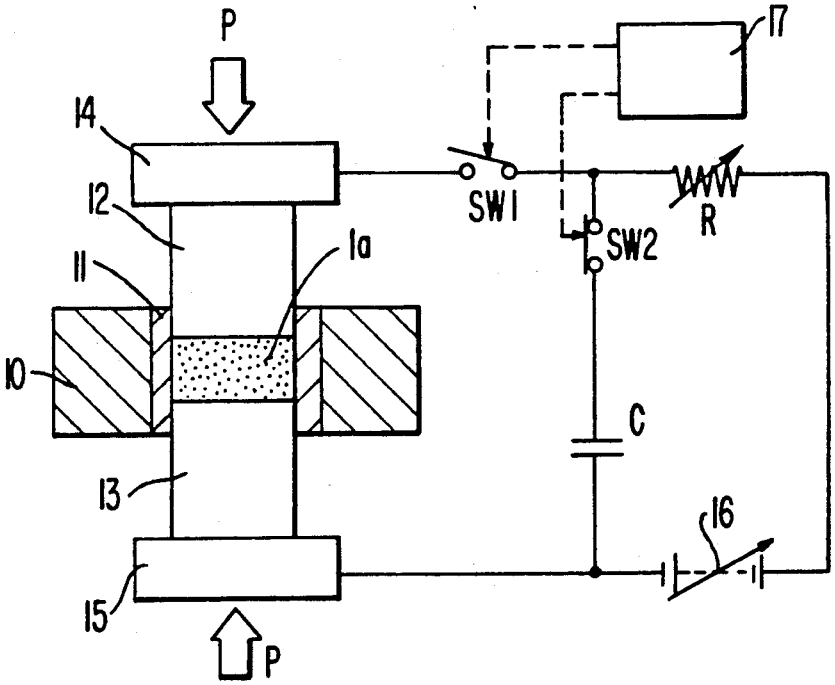
FIG. 3 is a circuit diagram of an apparatus for manufacturing the sintered body.

A sintering apparatus for producing such a sintered body according to the present invention is shown in FIG. 3. The sintering apparatus includes a sintering mold 10 which is is made of a highly strong metal such as tungsten steel, and has a central hole for placing a mass of powder 1*a*, i.e., the cluster 4 of capsule-like powder composite particles 1, to be sintered. The inner wall of the hole is coated with an insulating layer 11 which is electrically nonconductive.

Figure 4:
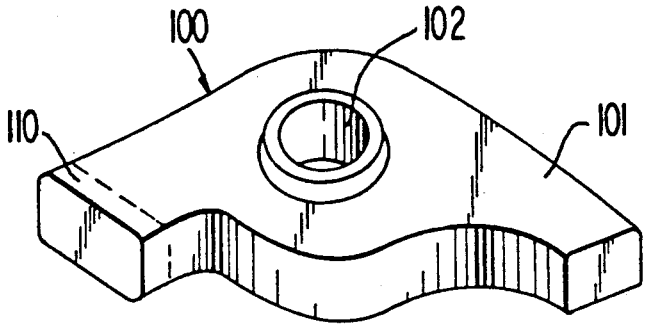
FIG. 4 is a perspective view of a partially hardened sintered body according to a first embodiment of the present invention, the partially hardened sintered body being in the form of a rocker arm.

Upper and lower plungers 12, 13 have lower and upper ends, respectively, inserted in the hole in the sintering mold 10. The mass of powder 1*a* is placed in the hole between the upper and lower plungers 12, 13. If a rocker arm 100 as shown in FIG. 4 is to be sintered from the mass of powder 1*a* by the sintering apparatus, the surfaces of the upper and lower plungers 12, 13 which contact the mass of powder 1*a* are shaped complementarily to the sides of the rocker arm 100. An electrically nonconductive core 12*a* (FIG. 5) for forming a shaft hole 102 (FIG. 4) in the rocker arm 100 is placed in the sintering mold 10.

The upper and lower plungers 12, 13 are connected respectively to upper and lower electrodes 14, 15. The upper and lower plungers 12, 13 and the upper and lower electrodes 14, 15 are controllably pressed by a hydraulic press in the directions indicated by the arrows P so that the powder in the sintering mold 10 is pressed, while a voltage is being applied thereto by the electrodes 14, 15.

The upper and lower electrodes 14, 15 are electrically connected to a series-connected circuit of switches SW1, SW2 and a capacitor C, and a series-connected circuit of a variable resistor R and a variable-voltage power supply 16 is connected parallel to a series-connected circuit of the capacitor C and the switch SW2. The switches SW1, SW2 are controlled by a controller 17. An electric current is supplied under a high voltage from the variable-voltage power supply 16 to charge the capacitor C through the resistor R and the switch SW2 which is closed. When the switch SW1 is closed, a high voltage is applied through the electrodes 14, 15 and the upper and lower plungers 12, 13 to the pressed powder to cause an electric discharge therein. Repeated application of the the high voltage to the pressed powder breaks oxides and other impurities on the surfaces of the covering particles 3, and hence purifies the surfaces of the covering particles 3, thus allowing the covering particles 3 to be fused together.

A sintered body according to a first embodiment of the present invention, which is manufacturing using the sintering apparatus described above, will be described below.

The sintered body according to the first embodiment is manufactured as the rocker arm 100 shown in FIG. 4. The rocker arm 100 has a main body 101 made of ordinary iron-base sintered powder according to JPMA standard SMF4020, i.e., composed of 0.2 to 0.8% of carbon, 1 to 4% of copper, and the rest of iron.

The rocker arm 100 also has an abrasion-resistant sliding surface 110 which is made of capsule-like power composite as shown in FIGS. 1 and 2. For example, the core particles are in the form of alumina ($Al_2O_3$) particles having a diameter ranging from 50 to 200$\mu$, and the covering particles are in the form of iron-base sintered powder particles whose diameter is about one-tenth of the diameter of the alumina particles. The capsule-like powder composite is manufactured as follows: 70% by weight of alumina particles and 30% by weight of iron-base sintered powder particles are sufficiently mixed with each other. Then, the mixture is kneaded in an electrostatically charged box, allowing the smaller iron-base powder particles to be electrostatically attracted to the alumina particles. The mixture is thereafter placed in a housing having rotary vanes which rotate at a speed ranging from 5000 to 7000 rpm. The rotary vanes are rotated for several minutes to cause the iron-base sintered powder particles to be firmly coated to the alumina particles, thus producing a capsule-like power composite.

Figure 5:
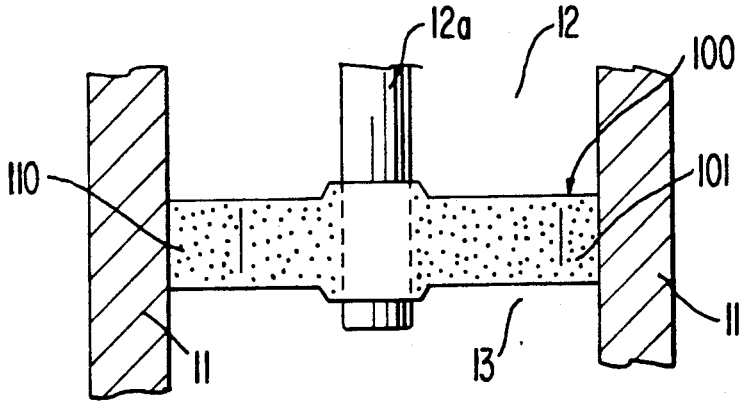
FIG. 5 is a cross-sectional view of a sintering mold for sintering the rocker arm shown in FIG. 4.

Then, the capsule-like powder composite is placed in a sintering mold shown in FIG. 5 at a position corresponding to a sliding surface portion 110 of the rocker arm 100, and a predetermined amount of iron-based sintered particles is placed in the sintering mode at a position corresponding to the main body 101 of the rocker arm 100. Then, a pulsed voltage is applied through the electrodes 14, 15 and the upper and lower plungers 12, 13 to the powder composite and the iron-base sintered particles in the sintering mold. Now, electric discharges are developed between the iron-base sintered particles on the surface of the capsule-like powder composite and also between the iron-base sintered particles corresponding to the main body 101. Repeated electric discharges break oxides and other impurities on the surfaces of the particles, and hence purifies the surfaces of the particles, which are then fused together. The particles in the sintering mode are now sintered into a rocker arm as shown in FIG. 4. The sliding surface portion 110 has an inner region made of alumina and a surface region of the same iron sintered particles as those of the main body 101. Therefore, the sliding surface portion 110 and the main body 101 can be sintered under the same condition by an electric current flowing therethrough.

In the above embodiment, a pulse voltage is applied to the particles filled in the sintering mold. Therefore, the covering particles of the capsule-like powder composite need to be electrically conductive. Alternatively, the particles in the sintering mold may be sintered by a hot-press process.

While in the above embodiment the core particles of the capsule-like powder composite in the sliding surface portion are of alumina, they may be of an abrasion-resistant ceramic material such as silicon carbide (SiC) or silicon nitride ($Si_3N_4$).

The covering particles of the capsule-like powder composite in the sliding surface portion are iron-based powder particles in the above embodiment. However, if the main body of the rocker arm is made of an aluminum alloy, then the covering particles are in the form of aluminum alloy particles.

Figure 6:
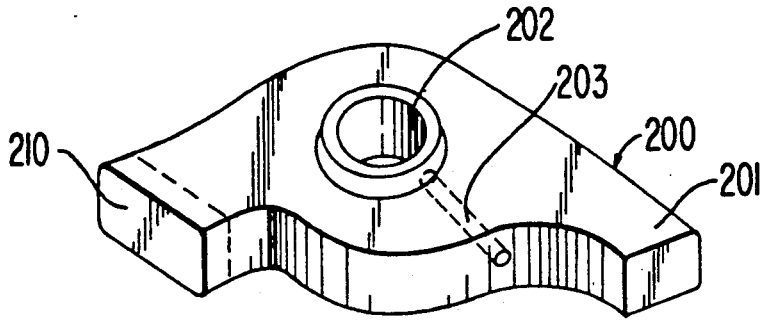
FIG. 6 is a perspective view of a partially hardened sintered body according to a second embodiment of the present invention, the partially hardened sintered body being in the form of a rocker arm.

FIG. 6 shows a sintered body as a rocker arm 200 according to a second embodiment of the present invention. The rocker arm 200 includes a main body 201 of an aluminum alloy.

To manufacture the sintered rocker arm 200 shown in FIG. 6, a capsule-like powder composite composed of alumina powder and aluminum alloy powder which are mixed at a predetermined ration is used to form a sliding surface portion 201, and aluminum alloy powder is used to form a main body 201. The rocker arm 200 has an oil hole which is formed by an aluminum pipe 203 embedded in the aluminum alloy powder.

Figure 7:
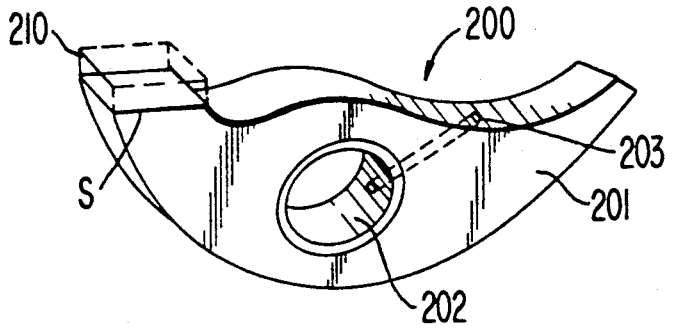
FIG. 7 is a perspective view of an arrangement for carrying out a method of manufacturing a partially hardened sintered body according to another embodiment of the present invention.
Figure 8:
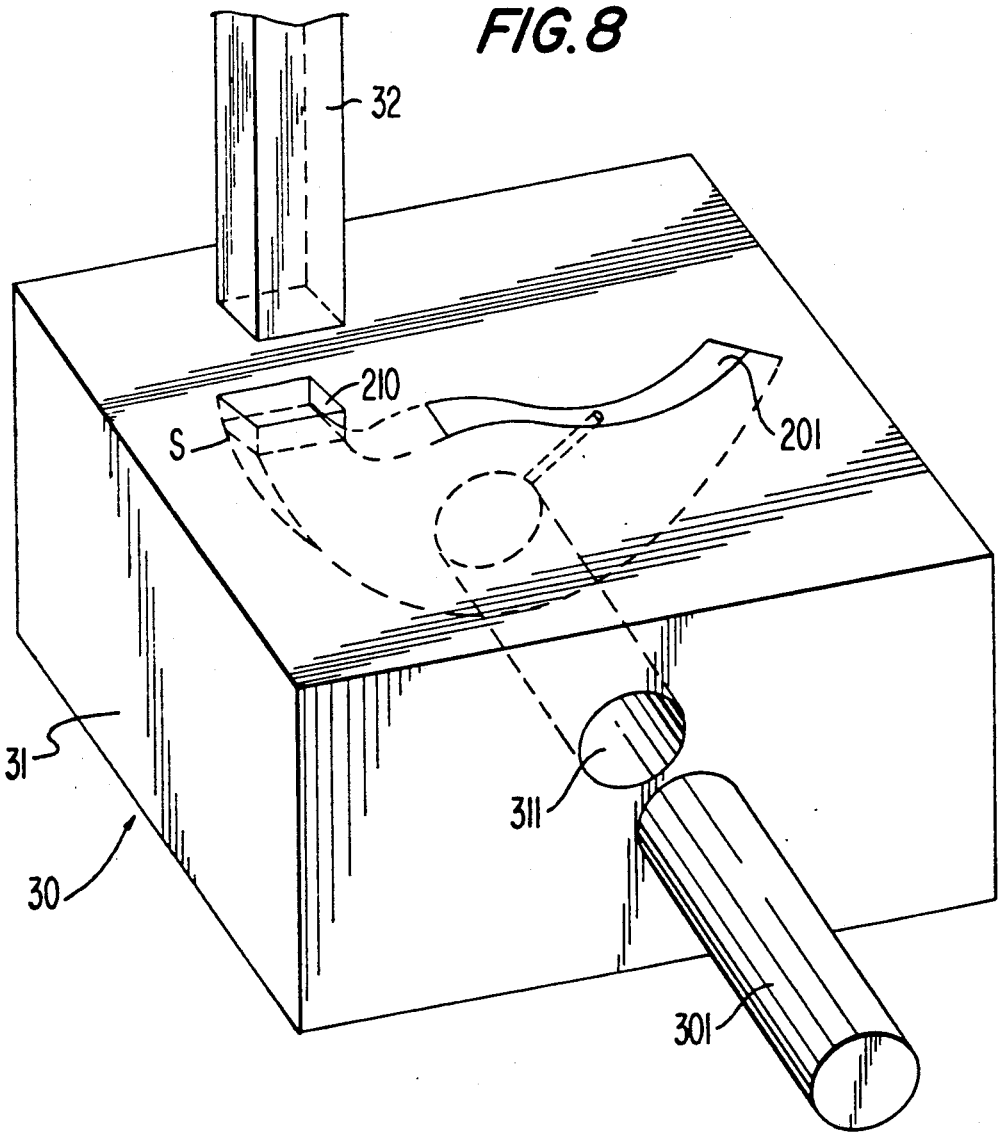
FIG. 8 is a perspective view of an alternative embodiment of a sintering mold according to the present invention.

FIG. 7 shown an arrangement for carrying out a method of manufacturing a partially hardened sintered body according to another embodiment of the present invention. The method shown in FIG. 7 may be employed to manufacture the rocker arm 200 shown in FIG. 6.

First, the main body 201 of the rocker arm 200 is sintered of aluminum alloy powder. Specifically, the aluminum pipe 203 for forming an oil hole is placed in a sintering mole, and then aluminum alloy powder is filled in the sintering mold. The main body 201 may then be sintered by the sintering apparatus shown in FIG. 3 or according to the hot-press process.

The sintered main body 201 is then placed in a lower mold member 31 of a sintering mold 30 (FIG. 7) with a surface S facing upwardly. The sliding surface portion 210 will be joined to the surface S. A shaft hole 202 defined in the main body 201 is aligned with a through hole 311 defined in the lower mold member 31, and a holder rod 301 is inserted through the through hole 311 and the shaft hole 202 to hold the main body 201 in position in the lower mold member 31.

Thereafter, a mass of capsule-like powder composite which is composed of core particles of alumina and covering particles of aluminum alloy powder is placed on the surface S of the main body 201. An upper mold member 32 is lowered onto the mass of capsule-like powder composite to pressurize the same. Then, a pulse voltage is applied to the capsule-like powder composite to sinter the same into a sliding surface portion 210. Since the covering particles of the capsule-like powder composite are of aluminum alloy powder which is the same as the material of the main body 201, the sintered sliding surface portion 210 is firmly bonded to the surface S of the main body 201.

In the above embodiment, a pulse voltage is applied to the capsule-like powder composite to sinter the same into the sliding surface portion 210. However, the sliding surface portion 210 may be sintered according to the hot-press process.

The partially hardened sintered body according to the present invention has been shown and described as being manufactured as a rocker arm. However, the partially hardened sintered body may be used as various other components and products.

Although certain preferred embodiments have been shown and described, it should be understood that many changes and modifications may be made therein without departing from the scope of the appended claims.

What is claimed is:

1. A partially hardened sintered body comprising powder forming a main body and a capsule-like powder composite disposed adjacent to said powder and composed of core particles made of a material harder than said powder and covering particles covering said core particles and made of the same material as said powder, said powder and said capsule-like powder composite being solidified.

2. A partially hardened sintered body according to claim 1, wherein said core particles are made of a ceramic material.

3. A partially hardened sintered body according to claim 1, wherein said covering particles are made of an iron-base material.

4. A partially hardened sintered body according to claim 1, wherein said covering particles are made of an aluminum material.

* * * * *

UNITED STATES PATENT AND TRADEMARK OFFICE

CERTIFICATE OF CORRECTION

PATENT NO. : 5,118,342

DATED : June 2, 1992

INVENTOR(S) : TADASHI KAMIMURA and AKIRA TSUJIMURA

It is certified that error appears in the above-identified patent and that said Letters Patent is hereby corrected as shown below:

Column 2, delete lines 55 through 58, and insert --Fig. 7 is a perspective view of the main body of the partially hardened sintered body of Fig. 6; and--.

Column 4, line 30, "power" should be --powder--;
line 35, "based" should be --base--.

Column 5, line 2, "based" should be --base--;
line 14, "ration" should be --ratio--;
line 15, "201" should be --210--;
line 16, after "201" insert --Fig. 7 shows the main body 201 prior to application of the sliding surface portion 210 which is shown in dotted lines in the figure--;
line 19, "7" should be --8--;
line 22, "7" should be --8--;
line 33, "7" should be --8--.

Signed and Sealed this

Twenty-fourth Day of August, 1993

*Attest:*

*Attesting Officer*

BRUCE LEHMAN

*Commissioner of Patents and Trademarks*